US005617967A

United States Patent [19]

Neidhart

[11] Patent Number: 5,617,967

[45] Date of Patent: Apr. 8, 1997

[54] COLLAPSIBLE STACKABLE PALLET CONTAINER

[75] Inventor: Fritz Neidhart, Weilheim, Germany

[73] Assignee: Clip-Lok International Limited, British Virgin Islands

[21] Appl. No.: 537,798

[22] PCT Filed: Apr. 29, 1994

[86] PCT No.: PCT/GB94/00937

§ 371 Date: Jan. 3, 1996

§ 102(e) Date: Jan. 3, 1996

[87] PCT Pub. No.: WO94/25355

PCT Pub. Date: Nov. 10, 1994

[30] Foreign Application Priority Data

Apr. 29, 1993 [DE] Germany ..... 43 14 150.1

[51] Int. Cl.[6] ..... B65D 21/032

[52] U.S. Cl. ..... 220/4.33; 206/600; 206/509; 220/636

[58] Field of Search ..... 220/4.28, 4.33, 220/635, 636; 206/386, 600, 511, 512, 509; 217/65, 66, 12 R, 43 A, 43 R

[56] References Cited

U.S. PATENT DOCUMENTS

| | | | |
|---|---|---|---|
| 3,251,322 | 5/1966 | Downs et al. . | |
| 3,266,656 | 8/1966 | Kridle | 220/4.33 |
| 3,323,674 | 6/1967 | Nist, Jr. | 217/43 A |
| 4,375,265 | 3/1983 | van de Wetering et al. | 206/511 |
| 4,673,087 | 6/1987 | Webb | 206/600 |
| 5,036,979 | 8/1991 | Selz | 206/600 |
| 5,109,986 | 5/1992 | Pruitt, Jr. . | |

FOREIGN PATENT DOCUMENTS

| | | | |
|---|---|---|---|
| 255323 | 9/1962 | Australia | 217/43 A |
| 1178431 | 5/1959 | France | 217/43 A |
| 2380952 | 9/1978 | France . | |
| 9304036 | 5/1993 | Germany . | |
| 4210435 | 7/1993 | Germany | 220/4.33 |
| 9306479 | 8/1993 | Germany . | |
| 1517312 | 7/1978 | United Kingdom . | |
| 2104582 | 3/1983 | United Kingdom . | |
| 2257453 | 1/1993 | United Kingdom | 220/4.33 |

*Primary Examiner* Stephen J. Castellano
*Attorney, Agent, or Firm* Ladas & Parry

[57] ABSTRACT

The present invention relates to transport containers with side walls connected to one another at their edges by clamps and with as a base a pallet which is also fastened to the side walls by clamps. The pallet is a four-sided pallet, with blocks arranged at the corners and possibly at predetermined distances along the edges of the base plate of the pallet and in the middle thereof. The outwardly directed side surfaces of the blocks are flush with the outer surfaces of the adjoining side walls. The transport container has skid planks which are fastened to the underside of the blocks. The outwardly directed side surfaces of the skid planks at least over part of their height, maintain a constant distance from the outwardly directed side surfaces of the block, and the distance is determined by the thickness of the side walls plus a handling play which is not greater than about half a wall thickness.

17 Claims, 4 Drawing Sheets

FIG 1
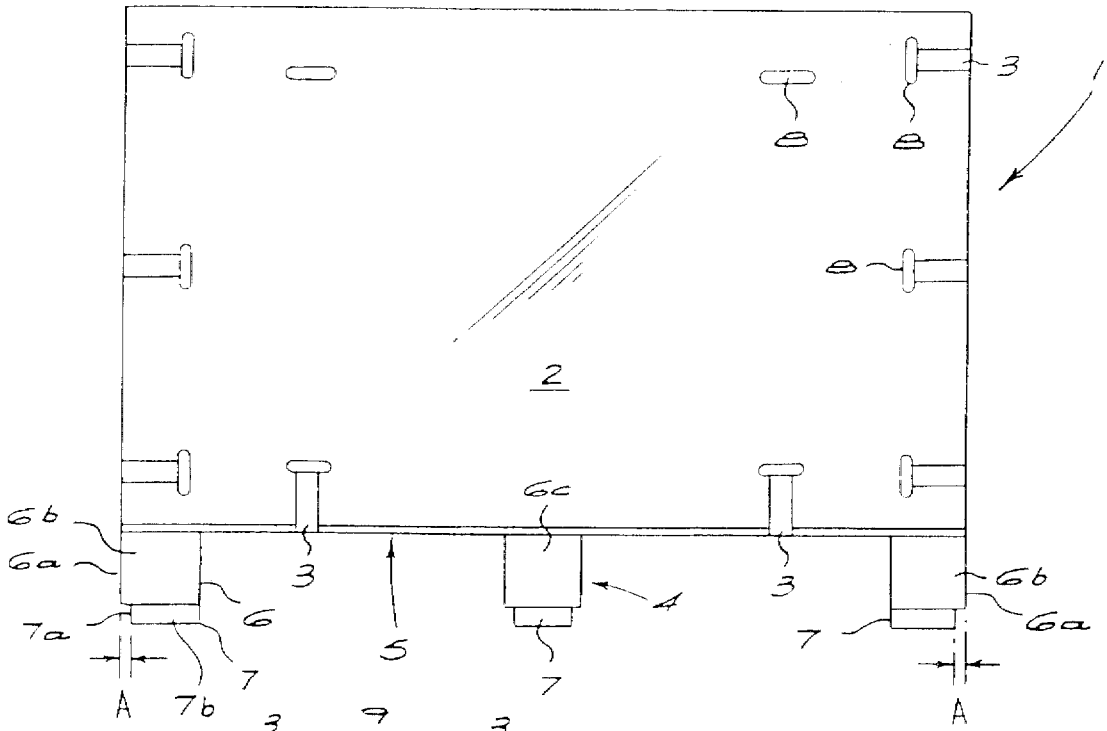
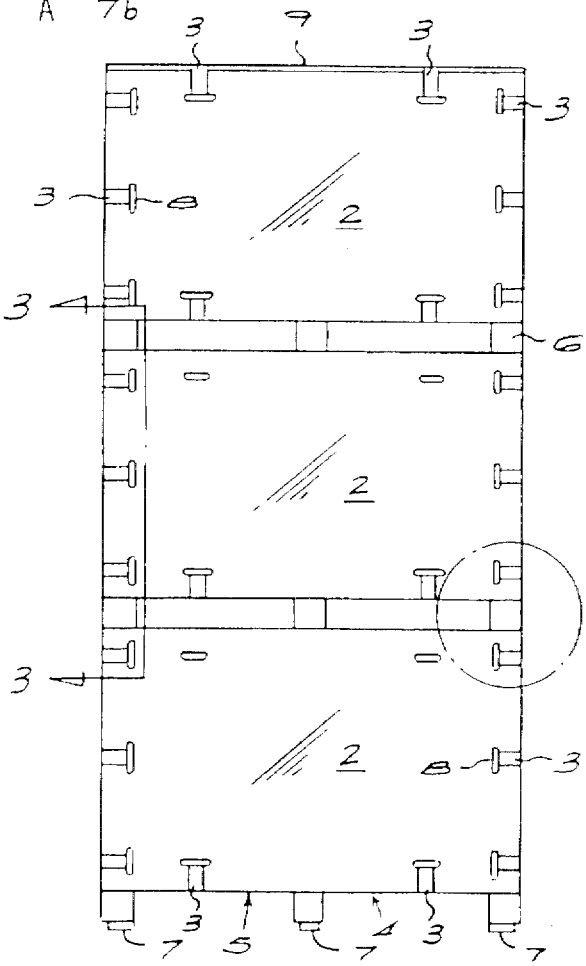
FIG 2
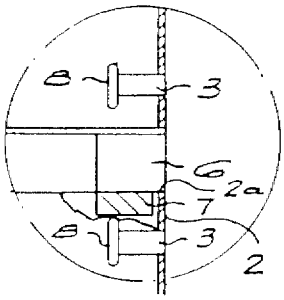
FIG 2A

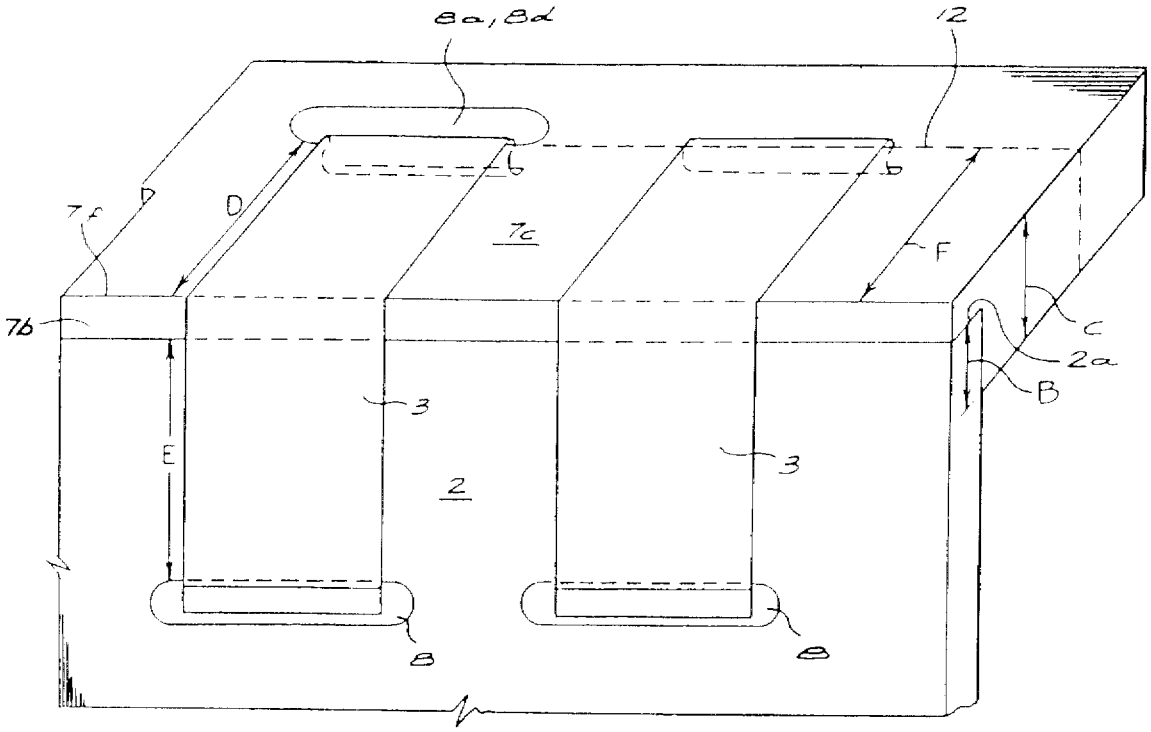
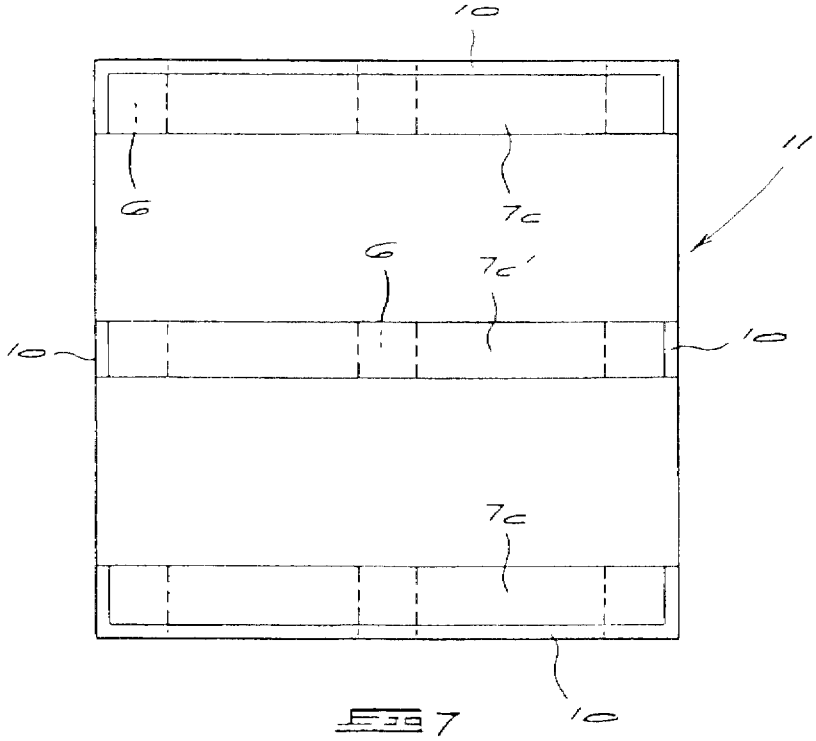
FIG 7

COLLAPSIBLE STACKABLE PALLET CONTAINER

The present invention relates to transport containers of the type having side walls connected to one another at their edges by clamps, and with a pallet as a base, the pallet also being fastened to the side walls by clamps. Such transport containers can be dismantled at the site of the consignee by loosening the clamps and stacking the side walls as well as the pallet on top of one another. In this state the transport containers can be returned to the sender, to be re-assembled there. Depending on the stresses to which they are exposed, such transport containers can be used several times until serious damage makes it necessary to take them out of circulation.

Such returnable transport containers must meet a multitude of requirements during handling. Among others, it must be possible to stack such containers, it must be ensured that the stacked containers will not slide sideways out of position, and furthermore the transport containers may not weigh more than is absolutely essential.

U.S. Pat. No. 5,109,986, which is the most relevant published document, discloses a collapsible transport container having side walls connected to one another by flexible straps so as to form a polygon which is expandable or collapsible to a rectangle or a flattened parallelogram. The bottom of the panels are removably attached to a pallet, which includes a platform which surmounts an array of spaced parallel skid planks. The ends of the skid planks extend beyond the side panels which they support, and the skid planks are provided with notches to enable one assembled container to be loosely stacked on another.

U.S. Pat. No. 3,251,322 discloses a materials handling pallet comprising a base plate supported on an array of pallet blocks arranged at least at the corners of the base plate, wherein the outwardly directed side surfaces of the blocks are flush with the corresponding outwardly directed side and end surfaces of skid planks supporting the blocks.

FR-A-2380952 discloses a set of stackable wooden crates which are designed in such a way that a superjacent crate may be stacked so as to span a pair of subjacent crates which are positioned along side one another. Each crate has a pair of plain skid planks extending across its base and the skid planks are arranged to locate inside the end walls of a subjacent crate, when the crates are stacked.

An object of the present invention is, therefore, to further develop a transport container of the above-mentioned type in such a way that it can be stacked without sliding out of position, whilst at the same time ensuring increased protection of the container parts during their use, reducing the mass of the container and the number of components used therein.

The invention accordingly provides a transport container comprising side walls connected to one another at their edges by clamps and a four-sided pallet, with blocks arranged at least at the corners of a base plate of the pallet and such that the forks of a forklift truck can be inserted there between, characterised in that the pallet is fastened to the side walls by clamps, the outwardly directed side surfaces of the blocks are flush with the corresponding outer surfaces of the adjoining side walls, skid planks are fastened to the undersides of the blocks, a rebate of width (A) is formed in an outwardly directed side surface of each skid plank such that, over part of its height, said side surface is rebated a constant distance (A) from the adjoining outwardly directed side surfaces of the adjoining blocks, the distance (A) being determined by the thickness of the side walls plus a handling play which is not substantially greater than half a side wall thickness, and the thickness and the material of the side walls are chosen such that a plurality of open transport containers can be stacked on top of one another, with the rebates in the skid planks of an upper container each resting on an upper edge of a side wall of the container positioned underneath.

Preferably, the outwardly directed side surfaces of the skid planks are, over part of their height, substantially flush with the adjoining outwardly directed side surfaces of the blocks.

The upper edge of the side walls of an underlying transport container, without a cover, can be used for the lateral guiding and holding in place of the transport container stacked on top of the underlying container. The four-sided pallet, which serves as a base plate, can rest with its blocks above the side walls of the transport container positioned underneath, so that the space between the blocks is not covered by the side walls of the underlying transport container. This permits the forks of a forklift truck to be easily guided in underneath the pallet.

The transport container of the first aspect of the present invention ensures increased protection of the container parts during their use. The load stresses are divided over the length of the skid planks, rather than being concentrated solely at the lowermost edges of the blocks. This reduces stress and wear on both the blocks and the upper edges of the container walls, and provides for greater load bearing capacity in respect of stacked containers. Furthermore, sensitive edge parts are protected against the effect of the forks of forklift trucks by the providing of robust and replaceable skid planks having rebates for protecting the upper edges of the container walls. The invention further provides effective protection against bulging out of the side walls of bulk material containers which may occur under heaving stress.

In an embodiment, over part of their height, the outer side surfaces of the outer skids are flush with the side surfaces of the end and side walls of the containers. The rebate is provided on the outer edge of the skids in such a way that the remaining part of the skid plank engages snugly within the underlying container in the stack. The top container therefore rests with the rebates at the outer edge of the outer skid planks and the front edges of the middle skid planks locating against the upper edges of the side walls of the container positioned underneath. The contact area provided between the rebates and the upper side edges of the underlying container has been increased compared to the first embodiment, in which the contact points are mainly constituted by the blocks. In addition, significant wear of the outer edges of the skids is prevented.

The outer skid planks are thus provided with an overhanging portion defined by the rebate, as a result of which the upper edges of the side walls are protected against damage by the forks of forklift trucks.

Furthermore, the clearance at the sides to which the skid planks extend perpendicularly is increased by the height of the overhanging portion of the skid planks in the area of the rebate, which makes it easier for the forks of a forklift truck to move beneath the pallet under difficult conditions.

In order to better absorb the lateral forces that occur on the side walls in the area of their upper edges under load conditions, the top clamps between the side walls are located close to the upper edge of the transport container.

In a further development, the top transport container can be closed by a cover, but all the transport containers stacked underneath generally do not require a separate cover, as this is provided by virtue of the bases of the superjacent containers. This saves covers, resulting in a reduction of the mass of the transport containers, and it also reduces the volume of the collapsed container parts when returning the empty containers to the sender. According to another further development, alternative slots and clamp locating means are located in the side walls and skid planks of each transport container, and the covers are suitable dimensioned so that interposing separate covers may be provided where necessary.

In a second aspect, the invention extends to a stack of transport containers wherein each transport container in the stack comprises side walls connected to one another at their edges by clamps and a four-sided pallet, with blocks arranged at least at the corners of a base plate of the pallet and such that the forks of a forklift truck can be inserted there between, characterised in that the pallet is fastened to the side walls by clamps, the outwardly directed side surfaces of the blocks are flush with the corresponding outer surfaces of the adjoining side walls, skid planks being fastened to the undersides of the blocks, the outwardly directed side surfaces of the skid planks, over at least part of their height, maintaining a constant distance (A) from the adjacent outwardly directed side surfaces of the adjacent blocks, the distance (A) being determined by the thickness of the side walls plus a handling play which is not substantially greater than half a side wall thickness, and in that a plurality of slots are arranged towards upper edges of the side walls, and the skid planks are provided with corresponding clamp locating means, whereby the clamps may be used to clamp the skid planks of an overlying container relative to the sides of a subjacent container in the stack.

Preferably, additional slots are located towards the upper edges of the outer sides of the side walls of the containers in the stack, the additional slots being vertically offset from the slots by a distance, which corresponds to the additional height contributed to the stack by a cover fitted to a subjacent container, so that the same clamps may be used to clamp the skid planks of one overlying container relative to the sides of the covered subjacent container.

The invention will now be explained in greater detail by means of a description of the exemplified embodiments, given with reference to the drawings, wherein:

FIG. 1 is a side view of a transport container lieing outside the scope of the first aspect of the invention and of a form which can be modified for use in a stack in accordance with the second aspect of the invention;

FIG. 2 shows a stack of transport containers according to FIG. 1;

FIG. 2A shows a detailed view of the edge part of FIG. 2.

FIG. 6 shows two variants of the fastening of the clamps to the skid planks; and FIG. 7 shows an underplan view of the transport container shown in FIG. 4.

Figure 3:
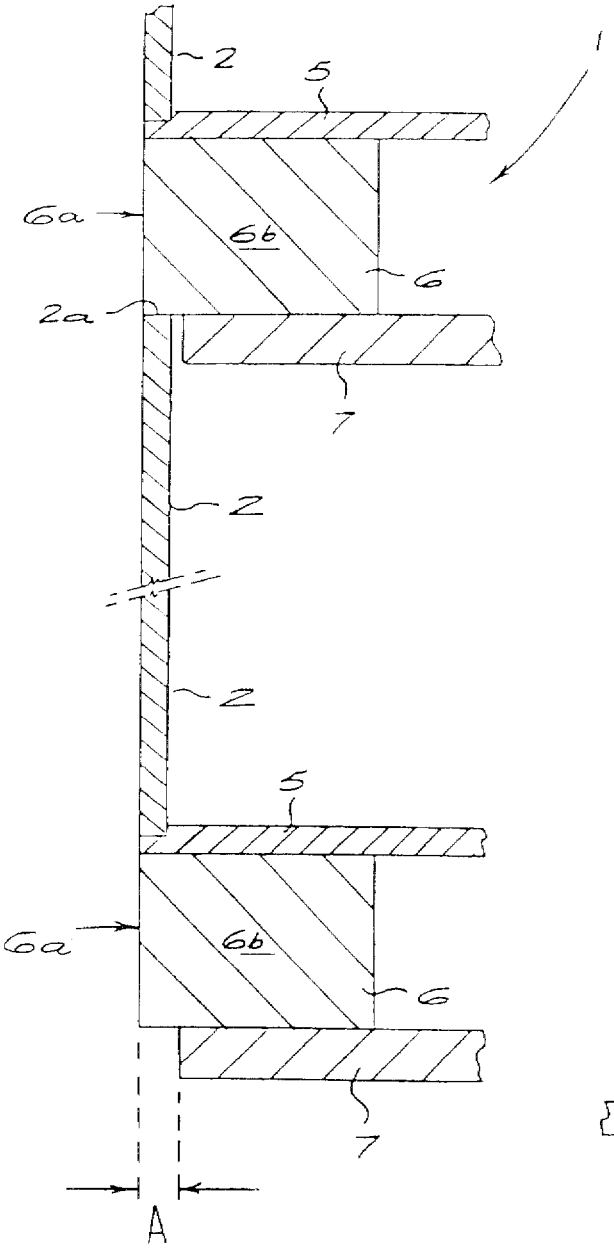
FIG. 3 is a perpendicular section through the edge part of two transport containers according to FIG. 1 stacked on top of one another.

FIG. 1 shows a transport container 1 in a side view. This transport container is substantially as described and claimed in German Utility Model 930 403 6.9. It should be noted that the container described in this document does not include clamp locating means for allowing the container to be included in a stack in accordance with the second aspect of the invention. Each side wall 2 is provided on its vertical edges with clamps 3, which engage in slots 8 and in this way produce the connection to the adjoining side walls and the base plate of the transport container. The base of the transport container is in the form of a four-sided pallet 4 with a base plate 5 and pallet block 6 which are arranged on the base plate in the usual manner, i.e. four blocks are arranged at the corners of the base plate in such a way that their outwardly directed side surfaces 6*a* and 6*b* are flush with the side walls of the transport container. The same applies to the blocks 6*c* which are arranged on the base plate at predetermined intervals along the outer edges of the base plate.

Provided on the blocks, in turn, are wooden skid planks 7, which are parallel to one another and to an edge of the base plate, and are each fastened to several overlying blocks by nails, rivets or the like.

The skid planks 7 are located on the underside of the blocks in such a way that their outwardly directed side and end surfaces 7*a* and 7*b* maintain a constant distance A from the outwardly directed side surfaces of the blocks. The value of this distance A is determined on the one hand by the thickness of the side walls of the transport container plus a handling play which is required for fitting the stacked transport containers together. This handling play may, of come, only be so great that it is guaranteed that the pallet blocks rest on the upper edge of the transport container positioned underneath. For this reason the handling play which is added to the wall thickness may not be greater than about half the wall thickness.

FIG. 2 shows a stack consisting of three transport containers according to FIG. 1. It will be noted that the middle and the top transport containers rest with their pallet blocks 6 on the upper edge 2*a* of the side wails positioned underneath them. The corresponding skids 7 project into the inside of the transport container, which is not closed by a separate cover, the cover being constituted by the overlying base plate. The skids secure against horizontal displacement and collapsing of the stack of transport containers.

During transport of stacks of containers in a large metal container, condensation water can penetrate from the roof of the metal container into the top transport container. The top transport container is consequently closed by a cover 9, which is in turn fastened to the side walls by clamps 3. The skid planks 7, in addition to securing the transport containers against horizontal displacement, in the case of a stack consisting of three transport containers, result in the savings of two covers, leading to a significant reduction in both mass and component count.

FIG. 2A shows an edge part in detail. It will be noted that the clamps 3 are arranged very close to the upper edge of the transport container.

This effectively prevents notching of the upper edges 2*a* of the side walls 2, which may occur when a transverse force is exerted on the edges by the skid planks 7 of the four-sided pallets. A steel band hooping, often used to stabilize the upper edges of the side walls, becomes superfluous as a result of the location of the clamps 3, thereby facilitating the handling of the transport containers, in particular during the assembling and dismantling thereof.

FIG. 3 shows a vertical cross section through the corner part of two stacked transport containers according to FIG. 1. The corner blocks 6 are fastened to the base plate 5 of the four-sided pallet, to which, in turn, the side walls 2 are fastened by clamps (not illustrated). The top transport container rests with its blocks 6 on the upper edge 2*a* of the side wall 2 of the transport container positioned underneath. The skid 7 locates within the transport container positioned underneath. The side surfaces of the skid 7 are positioned at a distance A from the outer side surface 6*a* of the block, which distance A is dimensioned as explained above.

Figure 4:
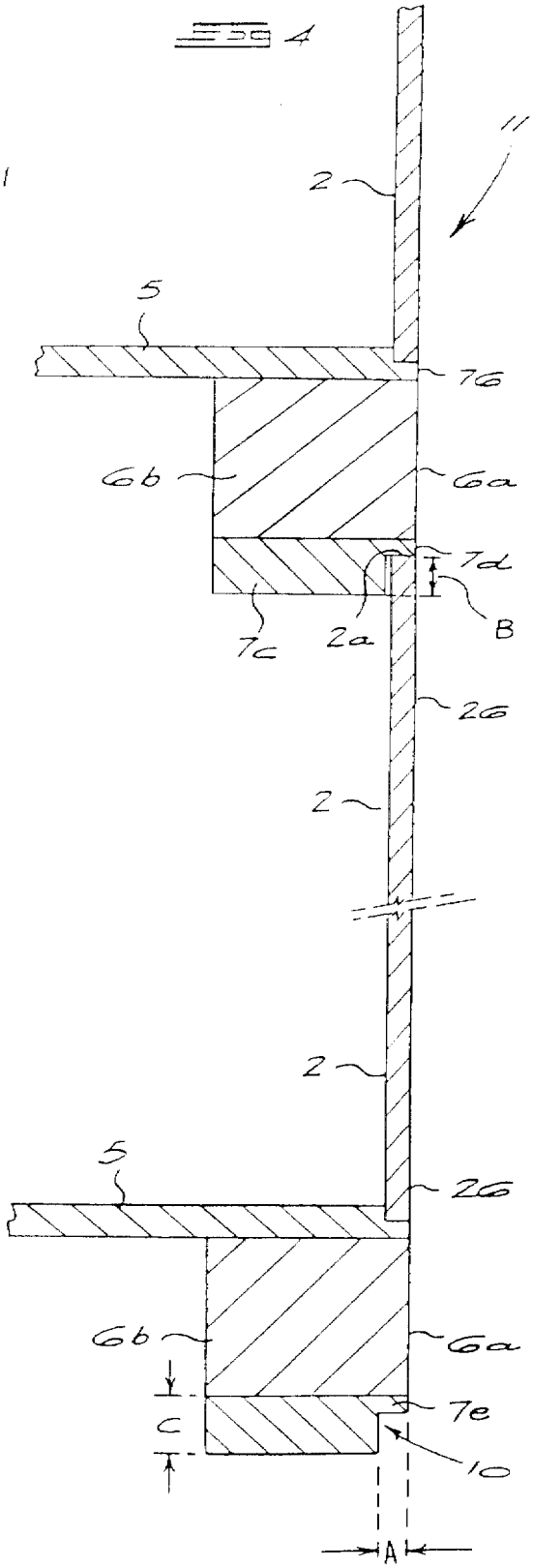
FIG. 4 is a perpendicular section through the edge parts of two transport containers according to a first aspect of the invention.

A preferred embodiment of a transport container 11 according to the first aspect of the invention is shown partly in cross section in FIG. 4, which shows essentially the same view as FIG. 3. An underplan view of the container is illustrated in FIG. 7. A rebate 10 is provided at the outer bottom edge of the outer skid planks 7*c*. This rebate has a width A which is the same as the distance at which, in the preceding exemplified embodiment, the outer side walls of the skid planks are positioned from the outside surfaces of the blocks and the side walls respectively. When stacking the containers on top of one another, every upper transport container rests with the rebate 10 provided in the outer and end faces of the outer skid planks 7*c* and in the end faces of the middle skid planks ($7c^1$) locating against the upper edge 2*a* of the side walls of the underlying transport container. A portion of the outer side surface 7*d* of the skid plank 7*c* lies flush with the outer side 6*a* of the block 6 and the outer surface 2*b* of the side wall 2. The height of the rebate is indicated in FIG. 4 by B, and is generally greater than half the skid thickness, but may be adapted to special requirements.

The skid thickness C may be the same as the thickness of the skids in the preceding exemplified embodiment, but may also have a different value to obtain specific advantages. It may, in particular, be greater in order to increase the height of the opening at the front between the stacked containers so as to facilitate the moving in of the forks of a forklift truck.

As the outer side faces 7*d* of the outer skid planks are flush with the outer surfaces 2*b* of the side walls, the overhanging portion 7*e* of the skid plank 7*c* that is left standing above the rebate 10 protectively covers the upper edge 2*a* of the side walls of the underlying container. In this way the upper edges 2*a* of the side walls can be effectively protected against notching or splitting by the underside of the forks of forklift trucks which engage underneath the container stacked on top.

Figure 5C:
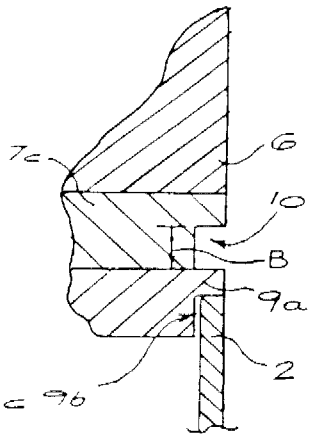
FIG. 5C shows a detailed cross section on the line 5C—5C of FIG. 5B.
Figure 5B:
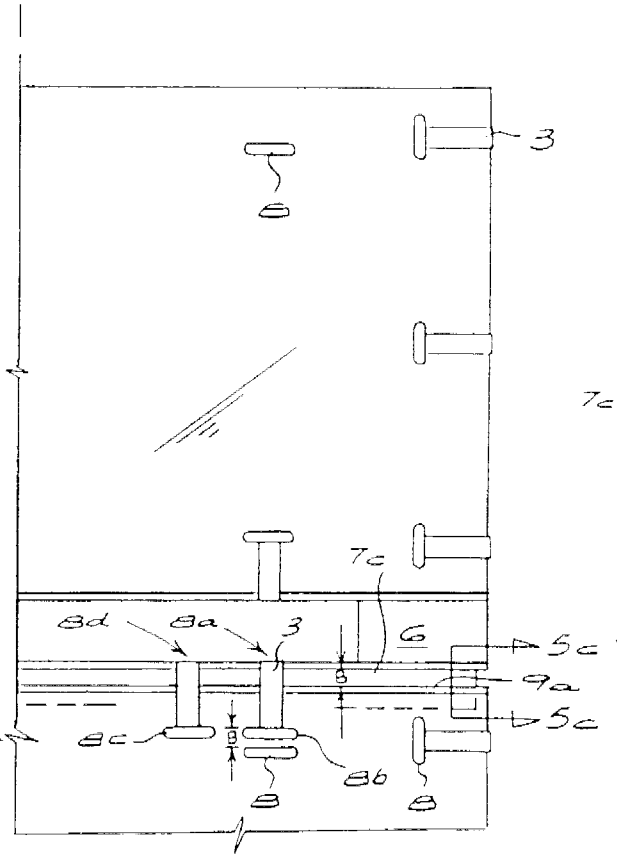
FIGS. 5A and 5B show stacked securing containers of FIG. 4 without and with an intervening cover.
Figure 5A:
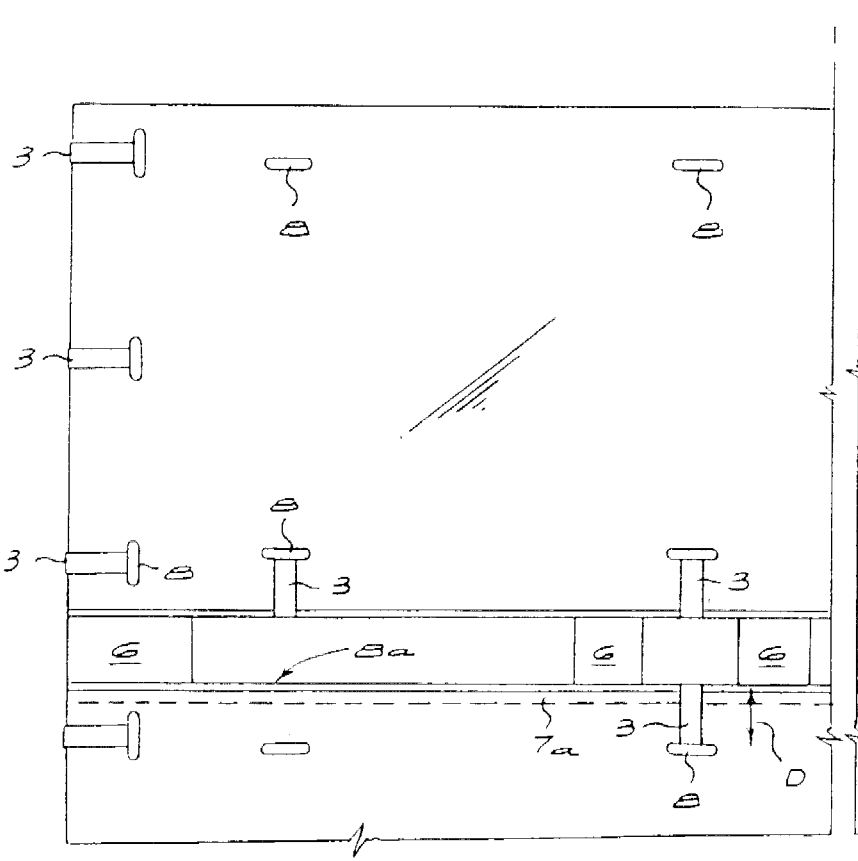

FIGS. 5A and 5B show a further advantageous development of the embodiment of the present invention shown in FIG. 4. FIG. 5A shows the case where containers are stacked without a cover. In FIG. 5B the bottom container is closed by a cover 9*a* and the top container rests with its skid planks 7*c* on the cover 9*a*. As is clear from. FIG. 6, slots 8*a* are provided on the upper side of the skid planks, which permit the side walls of the containers to be fastened at their upper edges to the outer skids of the container positioned on top of same, with the aid of the same clamps 3 which are also used to fasten the other container parts. This can effectively prevent a bulging outwards of the side walls when these are under a heavy load. This may occur, in particular, when the transport containers are filled with bulk material or a liquid in a foil container. The number of stack fastenings provided in this way depends on the one hand on the size of the transport containers or their width to length ratio, and on the other hand on the expected loading. In many cases one clamp 3 provided in the middle of the upper edge of the side wall will suffice. However, it is also possible to use several clamps 3, which are arranged at regular distances from one another.

Since the same clamps 3 are used for securing the stack as for assembling the side walls and the container base the distances of the slots 8 and 8*a* from the edges in question must be chosen correctly. This means that in the case of a stack where the lower containers do not have a cover, the side walls of the slots 8*a* against which the clamps engage must be arranged at a leg length D of the clamps 3 from the upper outer edge corner 7*f* of the outer skid planks, and the corresponding slots 8 located towards the upper edge 2*a* of the side walls must be arranged at a distance E from this upper edge, which distance is reduced by the residual thickness (C–B) of the overhanging portion 7*e* of the skid plank 7*c*. In order that with this configuration the same slots 8 can be used as are used for fastening the container covers 9*a*, it is necessary that the container covers also have a protruding thickness which corresponds to the residual thickness (C–B) of the overhanging portions 7*c* of the skids in the area of the rebate 10. A rebate 9*b* is typically provided having the same dimensions as the rebate 10 at the outer edges of the cover 9*a* to create the same conditions there.

Where the lower containers are provided with a cover, as is shown in FIG. 5B, a secured stack of transport containers is desirable. This is especially so as the upper edges 2*a* of the underlying side walls no longer locate within the rebates on the skid planks, and the resultant transverse hold no longer exists when the top container stands with its skids on the cover of the container positioned underneath.

In FIG. 5B, the upper side of the skid planks 7*c* lies higher by the rebate height B than in the case of a stack without a cover 9*a*. An additional two slots 8*b* or 8*c* must, therefore, be provided in the side walls 2, which are vertically displaced relative to the slots 8 by the distance B. Basically, two different arrangements of these second slots are conceivable.

On the one hand, the second slots 8*b* can be arranged above the first grooves 8, so that the clamps 3 engage into the same slot 8*a* of the skid plank 7*c* as in the case of a stack without a cover.

On the other hand, the second slots 8*c* may also be located along the side wall independent of and staggered relative to the first slots 8. In this case separate slots 8*d* must be provided at the same height at the corresponding points on the upper sides of the skid planks 7*c*.

FIG. 6 shows two embodiments of the fastening of the clamps 3 to the skid planks 7*c*. According to the first variant shown in the left, the clamp 3 engages in a slot 8*a* or 8*d* which is milled into the upper side of the skid plank 7*c*.

If the plank width F of the skid plank 7*c* is chosen to equal the leg length of the clamp 3, as is shown in broken outline at 12, then the clamp can engage behind the inside surface of the skid plank pointing away from the side wall of the container, at any free point of the skid plank, so that no predetermined fastening points need to be provided. This solution saves separate milling operations during the production of the skid planks and makes the overall system more flexible.

Thus, in its second aspect, the invention allows stacked containers to be secured together, with as well as without the use of container covers, by clamping of the subjacent containers to the overlying skid planks. The staggered or dual slot arrangement described above allows for identical clamps to be used in the case where covered or uncovered containers are stacked.

I claim:

1. A stack of transport containers wherein each transport container in the stack comprises side walls connected to one another at their edges by clamps and a four-sided pallet, with blocks arranged at least at the corners of a base plate of the pallet and such that forks of a forklift truck can be inserted therebetween, the pallet fastened to the side walls by clamps, the outwardly directed side surfaces and of the blocks are flush with the corresponding outer surfaces of the adjoining side walls, skid planks being fastened to the undersides of the blocks, the outwardly directed side surfaces of the skid planks, over at least part of their height, maintaining a constant distance from the adjacent outwardly directed side surfaces of the adjacent blocks, the distance being determined by the thickness of this side walls plus a handling play which is not substantially greater than half a side wall thickness, and in that a plurality of slots are arranged towards upper edges of the side walls and the skid planks are provided with corresponding clamp locating means, whereby the clamps may be used to clamp the skid planks of an overlying container relative to the sides of a subjacent container in the stack.

2. A stack of transport containers according to claim 1, wherein additional slots are located towards the upper edges of the outer sides of the side walls of the containers in the stack, the additional slots being vertically offset from the slots by a distance, which corresponds to the additional height contributed to the stack by a cover fitted to a subjacent container, so that the same clamps may be used to clamp the skid planks of one overlying container relative to the sides of the covered subjacent container.

3. A stack of transport containers according to claim 2, wherein the stack includes at least one cover having rebates formed at its outer peripheral edge, the width and height of which correspond to rebates formed in the skid planks for accommodating the upper side edges of the subjacent containers.

4. A transport container comprising side walls connected to one another at their edges by clamps and a four-sided pallet, with blocks arranged at least at the corners of a base plate of the pallet and such that the forks of a forklift truck can be inserted therebetween, the pallet fastened to the side walls by clamps, outwardly directed side surfaces of the blocks are flush with the corresponding outer surfaces of the adjoining side walls, skid planks are fastened to the undersides of the blocks, a rebate of width formed in an outwardly directed side surface of each skid plank such that, over part of its height, said side surface is rebated a constant distance from the adjoining outwardly directed side surfaces of the adjoining blocks, the distance being determined by the thickness of the side Walls plus a handling play which is not substantially greater than half a side wall thickness, and the thickness and the material of the side walls are chosen such that a plurality of open transport containers can be stacked on top of one another, with the rebates in the skid planks of an upper container each resting on an upper edge of a side wall of the container positioned underneath, the clamps for connecting the side walls being distributed at predetermined distances along the container edges and the clamps arranged nearest the upper edges of the container being located at a distance of a length of a clamp leg or less from the upper edges of the container.

5. A transport container comprising side walls connected to one another at their edges by clamps and a four-sided pallet, with blocks arranged at least at the corners of a base plate of the pallet and such that the forks of a forklift truck can be inserted therebetween, the pallet fastened to the side walls by clamps, outwardly directed side surfaces of the blocks are flush with the corresponding outer surfaces of the adjoining side walls, skid planks are fastened to the undersides of the blocks, outwardly directed side surfaces of each of the skid planks, over part of their height, being substantially flush with the adjoining outwardly directed side surface of the blocks and, over part of their height, having a rebate of width formed in an outwardly directed side surface of each skid plank such that part of said side surface is rebated a constant distance from the adjoining outwardly directed side surfaces of the adjoining blocks, the distance being determined by the thickness of the side walls plus a handling play which is not substantially greater than half a side wall thickness, and the thickness and the material of the side walls are chosen such that a plurality of open transport containers can be stacked on top of one another, with the rebates in the skid planks of an upper container each resting on an upper edge of a side wall of the container positioned underneath, the clamps for connecting the side walls being distributed at predetermined distances along the container edges and the clamps arranged nearest upper edges of the container being located at a distance of a length of a clamp leg or less from the upper edges of the container.

6. A transport container according to claim 4 or 5, wherein the distance of the uppermost clamps connecting the side walls from the upper edge of the container is chosen as small as the secure providing of a slot in the side walls for fastening of the clamps permits.

7. A transport container according to claim 4 or 5, further comprising a cover provided for closing the container when the container is arranged as the top container in a stack of containers.

8. A transport container according to claim 4 or 5, wherein the skid planks include outer skid planks, and both the outwardly directed side and end surfaces of the outer skid planks are provided with rebates having the width.

9. A transport container according to claim 8 wherein at least one intermediate skid plank is located between the outer skid planks, and the outwardly directed end surfaces of the intermediate skid plank are similarly provided with rebates having the width.

10. A transport container according to claim 8, wherein the height of the rebate is greater than half the thickness of the skid planks.

11. A transport container according to claim 7, wherein the container cover has rebates at its outer peripheral edge, the width and height of the rebates of the cover corresponding to the width and height of the rebates of the skid planks.

12. A transport container according to claim 8, wherein outer skid planks are provided on their upper side with at least one clamp locating means, which is arranged in such a way that it lies at the same distance from an upper outer edge of the outer skid plank as at least one of the slots arranged towards an upper edge of the side walls, so that the side walls are secured to the skid plank by at least one clamp which engages into at least one slot of the side walls and the locating formation of the skid planks.

13. A transport container according to claim 12, wherein the clamp locating means is in the form of at least one slot positioned at evenly spaced intervals along the outer skid plank.

14. A transport container according to claim 13, wherein the outer skid plank has a width corresponding to the distance, and the locating formation is constituted by the inside surface of the skid plank which faces away from the side wall of the container.

15. A transport container according to claim 8, wherein additional second slots are arranged towards the upper edges of the outer sides of the side and end walls respectively, the uppermost walls of the second slots being located one rebate height nearer the upper edge of the end and side wall, respectively, than the corresponding uppermost slot walls of the slots.

16. A transport container according to claim 15, wherein the additional second slots are arranged above the slots on the side and end walls, respectively.

17. A transport container according to claim 15, wherein the additional second slots are laterally offset from the first slots and in that corresponding slots are arranged on the upper sides of the skid planks for accommodating the clamps.

* * * * *